United States Patent [19]

Ramirez-Jauregui

[11] 4,384,627

[45] May 24, 1983

[54] RETRACTABLE WELL DRILLING BIT

[76] Inventor: Carlos Ramirez-Jauregui, Avellanos 31, S. Mateo, Mexico

[21] Appl. No.: 241,473

[22] Filed: Mar. 9, 1981

[30] Foreign Application Priority Data

Mar. 11, 1980 [MX] Mexico ..... 181507

[51] Int. Cl.[3] ..... E21B 10/66

[52] U.S. Cl. ..... 175/260

[58] Field of Search ..... 175/260, 261

[56] References Cited

U.S. PATENT DOCUMENTS

| | | | |
|---|---|---|---|
| 1,002,793 | 9/1911 | Wilcox | 175/261 |
| 1,412,101 | 4/1922 | Carter | 175/261 X |
| 1,502,463 | 7/1924 | Dunsworth | 175/261 |
| 1,597,143 | 8/1926 | C arter | 175/261 X |
| 1,617,043 | 2/1927 | Carter | 175/260 X |
| 1,833,134 | 11/1931 | Stokes | 175/260 X |

*Primary Examiner*—Stephen J. Novosad

*Assistant Examiner*—Joseph Falk

*Attorney, Agent, or Firm*—Darby & Darby

[57] ABSTRACT

A retractable well drilling bit comprises a hollow body which forms the lowermost end of the drilling string; a pair of colinear cylindrical hollow members slidable within the bore of said hollow body; a pair of knives; a vertical rod attached to the lower one of said cylindrical members and slidable within the upper one of said cylindrical members between a knife-retracted and a knife-extended position, said knives being pivotally engaged to the lower end of said rod; and a pair of crossed links pivotally attached to said upper body at the upper ends thereof and to each knife at the lower ends thereof respectively, such that by spacing said upper member from said lower member, said links will pull said knives rotating same in a knife-retracting direction, whereas when said members are approached to each other, said knives will be pushed by said links in a knife-extending position.

7 Claims, 4 Drawing Figures

RETRACTABLE WELL DRILLING BIT

FIELD OF THE INVENTION

The present invention refers to well drilling bits and, more particularly, it refers to a retractable well drilling bit which is capable of being retracted for replacement purposes without the need of disassembling the string supporting the same.

BACKGROUND OF THE INVENTION

Well drilling bits and particularly oil well drilling bits are very well known devices of which there is a very important variety with different designs and special characteristics for use in all the possible conditions of operation of the same for drilling down to find oil, water and the like.

However, up to the present time it has been customary that, when the bit is worn out by use of the same, the whole drilling string has to be disassembled and extracted from the length of well already drilled in order to replace the bit and resume the drilling operation, after placing the bit on the tip of the drilling string and reassembling the same to continue drilling.

This has been a considerable drawback of all the drilling bits known in the prior art, inasmuch as the trend of the workers in the art has been towards the obtention of more resistant drilling bits in order to lengthen the operational life thereof to thus avoid frequent removals of the drilling string and the worn out bit, which is obviously a costly and cumbersome operation.

It has been thought in the past that providing a mechanism for retracting a bit might cause considerable problem in the normal drilling operation, whereby the research activities in this field have gone, as mentioned above, in a different direction and have rather been towards the obtention of better materials than towards the design of a mechanism for retracting a drilling bit with the purpose of preventing the up to now necessary string disassembling operation which has caused so many problems in the drilling art.

To the knowledge of applicant, there is no retractable drilling bit in the prior art that may have been designed appropriately to serve its function in an efficient manner, whereby the drilling art is in high need of said type of a drilling bit, in order to avoid unnecessary cost increases caused by the necessity of disassembling the string for replacing the bit, particularly when the well has been drilled down to a considerable depth.

BRIEF SUMMARY OF THE INVENTION

Having in mind the defects of the prior art drilling bits, it is an object of the present invention to provide a retractable well drilling bit which is of a very simple construction and yet of a high efficiency and which will avoid the necessity of pulling out the drilling string for purposes of replacement of the bit.

Another object of the present invention is to provide a retractable well drilling bit of the above mentioned character, which will comprise a very sturdy and simple mechanism for retracting a pair of knives and extending the same at will, without the need of intricate mechanisms and costly operations.

A more particular object of the present invention is to provide a retractable drilling bit, of the above described nature, which will be capable of retracting and extending the knives thereof in an automatic manner when the bit is placed at the bottom of the drilling string, and which may be pulled out from the well without the need of disassembling the said drilling string.

The foregoing objects and others ancillary thereto are preferably accomplished as follows:

I provide a retractable well drilling bit which comprises a hollow body which forms the lowermost end of the drilling string, a pair of colinear cylindrical hollow mambers slidable within the bore of said hollow body; a pair of knives; a vertical rod attached to the lower one of said cylindrical members and slidable within the upper one of said cylindrical members between a knife-retracted and a knife-extended position, said knives being pivotally engaged to the lower end of said rod; and a pair of crossed links pivotally attached to said upper member at the upper ends thereof and to each knife at the lower ends thereof respectively, such that by spacing said upper member from said lower member, said links will pull said knives rotating same in a knife-retracting direction, whereas when said members are approached to each other, said knives will be pushed by said links in a knife-extending position. The operation of the retractable well drilling bit is very simple, inasmuch as, when replacement thereof becomes necessary, a pulling member is introduced into the drilling string, is hooked to the upper hollow member of the bit, is pulled outwardly in order to space the upper from the lower members and thus act on the links for retracting the knives and, upon completion of said retraction of the knives, the pulling member is pulled out of the string carrying the retractable bit which may be either replaced or repaired for further introduction of the same for resuming the drilling operation. For introducing the bit, the reverse operation is effected, and when the lower member of said bit reaches the bottom of the drilling string, it abuts against a flange provided for said purpose at the lowermost end of said string, whereby the upper member will approach the lower member thereby extending the knives for resuming operation.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of a specific embodiment when read in connection with the accompanying drawings, in which:

DETAILED DESCRIPTION

Figure 1:
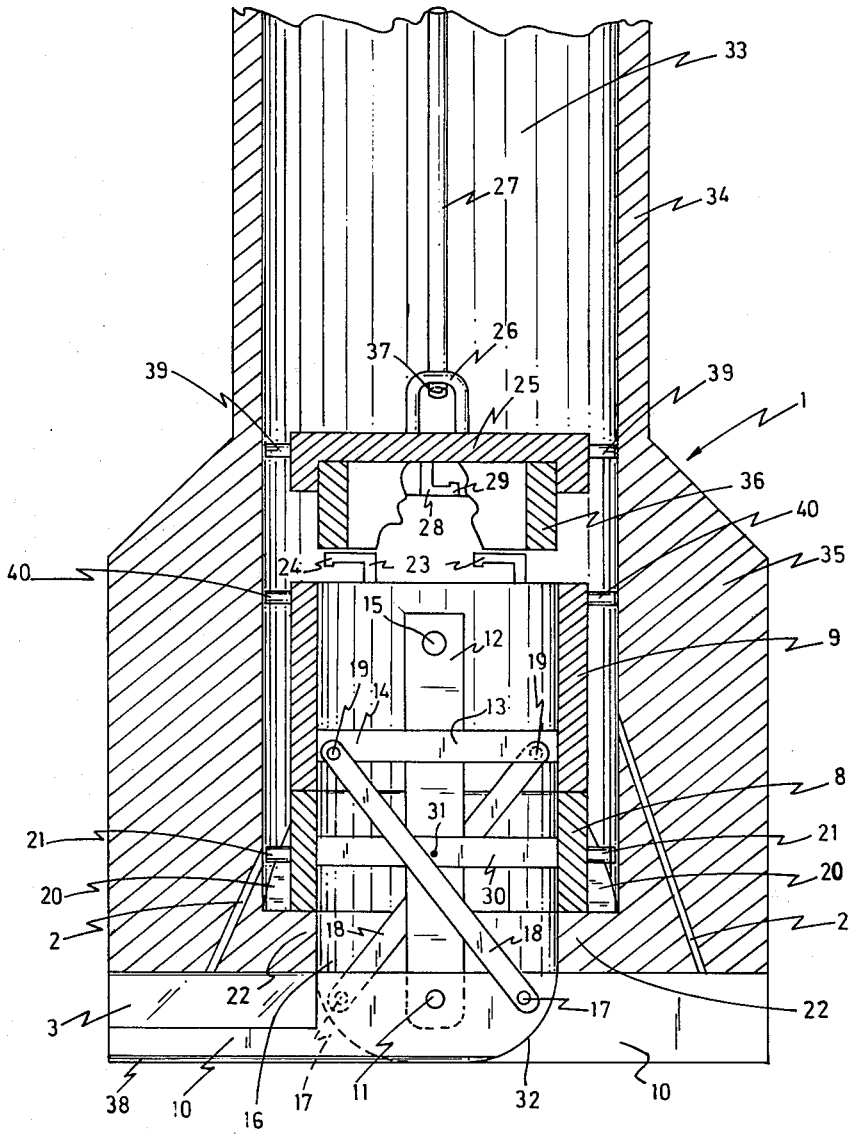
FIG. 1 is a cross-sectional elevational view of a retractable well drilling bit built in accordance with the present invention, shown in its operating condition.

Having now more particular reference to the drawings, the drilling bit built in accordance with the present invention is formed by a hollow body or housing 1 constituted by a pair of integral members 34 and 35 which form the lowermost end of the drilling string, said member 35 being of a larger outer diameter than the body 34 and obviously than the pipe string, and said body 34 being threadably engaged in the usual manner, at its upper end, (not shown) to the drilling string.

The body or housing 1 of the drilling bit comprises, as mentioned above, an upper tubular member 34 which forms an inner chamber 33 which is exactly of the same inner and outer diameter as the corresponding piping forming the drilling string, whereas the lower tubular member 35 is of a larger outer diameter and may be designed of any dimensions in accordance with the diameter desired for the well bore. The inner portion of the member 35 is also hollow and cylindrical, having the same inner diameter as the upper tubular member 34 and the drilling string.

The body 1 has as its main purpose to house and engage the drill bit proper to the piping string, as well as to provide sufficient and adequate resistance to the knives of the bit for bearing all the stresses to which said knives are subjected during the drilling operation. Also, body 1 serves to guide any drilling mud or fluid to the suitable places in order to maintain the bit clean, cold and lubricated and remove the dirt derived from the cutting operation and extract it from the well. The said drilling fluid is introduced into the well bore by means of suitable borings 2 (FIGS. 1 and 3 of the drawings) which may be of a diameter and may be provided in a number and at positions designed in accordance with the diameter of the well, as well as with the hardness of the soil layer which is being drilled.

On the lower face of body 1 there are provided two radially directed ribs 3, almost matching the diameter and parallel thereto, said ribs 3 having a cross-section which is triangular for providing a vertical front or attacking face and on which the knives 10 are backed up, for providing sufficient resistance to said knives when the same are rotated. In other words, the knives 10 always carve into the soil, bearing on each one of the ribs 3 as more clearly shown in FIGS. 1 and 3 of the drawings. In this manner, the strength of the knives 10 is considerably increased because they bear on the lower face of the body 1 on the one hand and they are backed up by the ribs 3 on the other hand.

Figure 3:
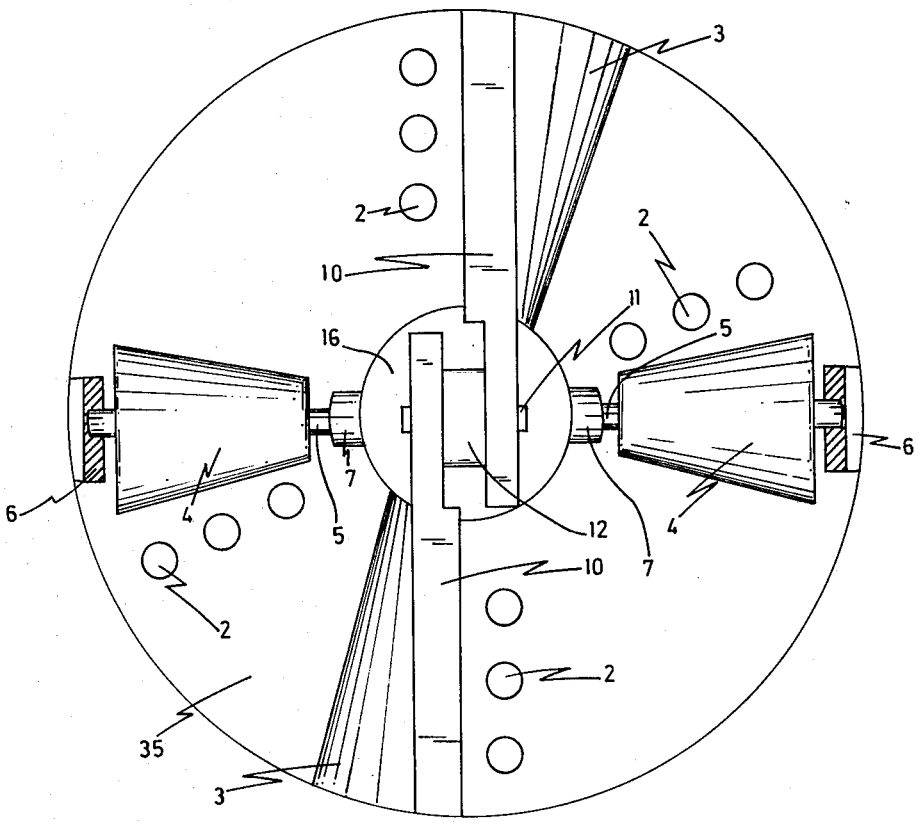
FIG. 3 is a bottom plan view of the retractable well drilling bit of the present invention, showing the details of the supporting assembly thereof.
Figure 4:
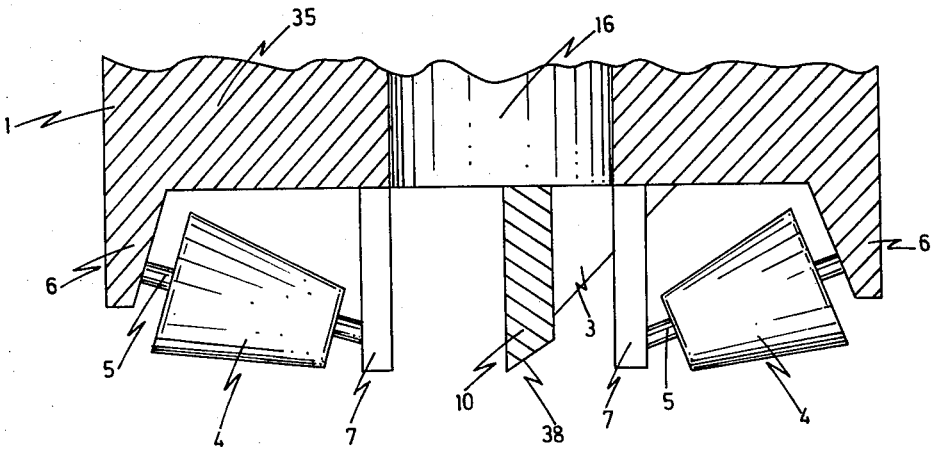
FIG. 4 is a fragmentary cross-sectional elevational view of the lower end of the drilling bit of the present invention, shown at an angle of 90° as compared to the views of FIGS. 1 and 2, in order to show certain details thereof.

Body 1 has also at its lower face and perpendicularly arranged to the ribs 3, and also in a radial direction, a pair of conical rollers 4, journalled by means of the axles 5 on an outer projection 6 and on an inner projection 7, respectively, as clearly shown in FIGS. 3 and 4 of the drawings, and the lower surface of the conical rollers 4 coincides with the diameter of the bit such that they may freely roll on the soil when the bit is rotated.

The rollers 4 may be smooth, fluted or toothed, in order that, when they bear on the ground, said rollers will freely rotate when the bit is also rotated. The conical rollers 4 have as their objective to provide two additional supporting points for the bit in order to balance its vertical position, such that the bore being drilled may be preserved as a vertical bore, said conical roller being situated at an angle of 90° with respect to the position of the cutting elements or knives 10, thereby providing four supports equidistantly around the circumference of the bit.

It will be obvious for any one skilled in the art that the conical rollers 4 may be omitted from the bit construction of the present invention and may be replaced by mere blunt extensions of body 1 to balance the vertical position of the bit, or that any such device may be omitted, and the vertical position of the bit may be secured by the rigidity of the drilling string itself, particularly in cases where the soil being drilled is not extremely hard.

The cutting operation is effected by means of the knives 10 as mentioned above, which are two rectangular metallic knives supported at the lower face of body 1 of the bit, previously placed at the lower end of the drilling string as mentioned above. Knives 10, which are placed in its operational position, diametrically opposed on the bit, are close equivalents to the flutes of a shop drilling bit, and the front faces thereof with respect to the rotation of the bit, are provided with sharp edges 38 in the same manner as the flutes of the shop bits.

The body of the bit itself, which may be capable of being introduced or extracted from the drilling string without the need of disassembling the string, when replacement or repair of said bit is necessary, comprises two hollow cylindrical members 8 and 9 with the characteristics that shall be described more fully hereinbelow.

The knives 10 are pivotally supported at their inward end, by means of a pivot 11 which is located precisely at the center of the bit. The knives 10 extend beyond said pivot point 11 through a predetermined distance by means of a curved edge portion 32 which provides for the rotation of the knives 10 and their introduction within the reduced diameter opening 16 or mouth of the lower end of member 35, said opening being formed by the inwardly directed flange 22 which is provided at the lowermost end of said member 35 as clearly shown in FIGS. 1 and 2 of the drawings. This pivot 11 is in turn supported by means of a central vertical rod 12 which is in turn attached by means of a bolt 31, for instance, to a radial bar 30 attached to the lower cylindrical member 8 of the bit, whereas said rod 12 has, at a point near its upper end, a stop 15 and passes freely slidable through a slit 13 provided at a diametrically arranged bar 14 engaged to the upper cylindrical member 9 for purposes which will be described with more detail hereinbelow.

Figure 2:
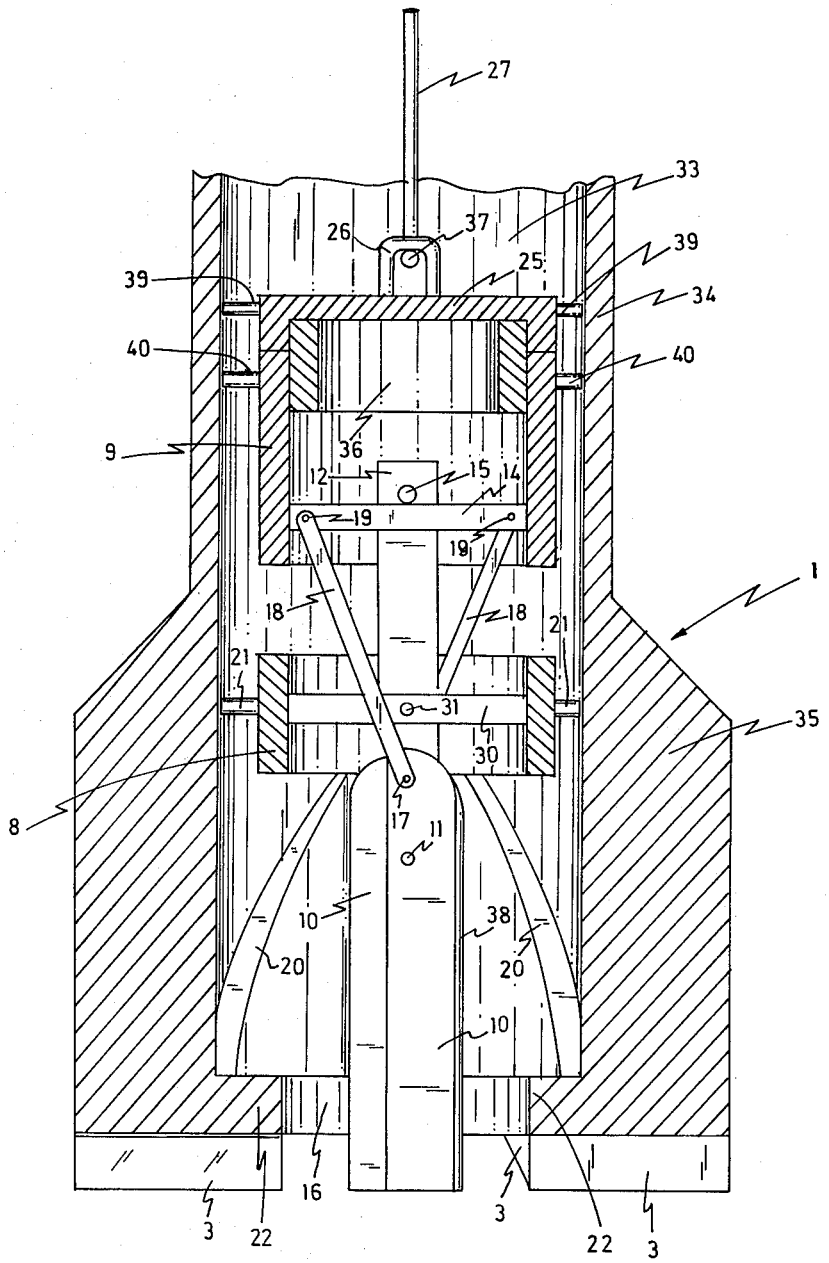
FIG. 2 is a view similar to FIG. 1 but showing the bit in a retracted condition and being extracted from the drilling string.

The stop 15 provided at the central vertical rod 12 and the slit 13 provided at the cross bar 14 of member 9, provide a certain amount of movement between the cylindrical members 8 and 9, from the position shown in FIG. 1 of the drawings wherein both members 8 and 9 are abutted, to the position shown in FIG. 2 of the drawings where members 8 and 9 are spaced, with the stop 15 of rod 12 engaged to the upper portion of bar 14 upon sliding of said rod 12 down through the slit 13 of bar 14 as explained above.

As seen in FIGS. 1 and 2 of the drawings, bar 14 of member 9 has two pivots 19 at both ends thereof, which respectively support a pair of links 18, the lower ends of which respectively support, through pivotal joints 17, the ends of the knives, at a point which is nearer to the inner end of each knife than the center pivot 11 described above. The link 18 starting from the left pivot 19 of bar 14 (as shown in FIG. 1) extends diagonally towards the right to be pivotally engaged by means of pivot 17 to the left knife 10, whereas conversely, the link 18 starting at pivot 19 at the right of bar 14, extends diagonally towards the left to support by means of the respective left pivot 17, the right knife 10 at the extreme left end thereof.

A pulling or hooking member is provided in order to actuate the bit built in accordance with the embodiment shown in FIGS. 1 and 2 of the drawings, and comprises a plate member 25 having a plurality of hooks 28 with outer ridges 29, whereas the member 9 has, at its upper edge, complementary hooks 23 having also ridges 24. The plate member 25 has a cylindrical guide member 36 of a diameter suitable for being guided into the bore of member 9, for a purpose which will be explained in detail hereinbelow. Plate member 25 is provided with a lug 26 through which a hook 37 attached to a pulling cable 27 may be passed, for purposes of extracting the bit from the well through the bore of the drilling string, generally designated by means of the reference numeral 33.

The operation of the retractable bit built in accordance with the present invention is as follows:

The arrangement of the hooks 23 and 28 is such that, when the bit of the present invention is in the operating position, the pulling element is inserted into the bore divided by a plurality of radially directed bolts 39 which bear on the inner surface of the string, downwardly until its guide member 36 engages member 9, and the drilling string is then rotated in a direction opposite to the drilling rotation, whereby the hooks 23 and 28 will be engaged to each other by means of their respective ridges 29 and 24, whereafter the plate member 25 is pulled up by means of cable 27, thus lifting the upper member 9 of the bit, which is guided by a plurality of radially directed guiding bolts 40 bearing against the inner surface of member 1, whereby the links 18 will be pulled, carrying therewith the pivots 17 and rotating the knives 10 through an angle of approximately 90° to place them in a position as shown in FIG. 2 of the drawings. Of course the rod 12 will slide through the slit 13 of bar 14 of member 9, whereby said links 18 may be actuated when pulling the device by means of the plate member 25.

Once the knives are in approximately vertical position as shown in FIG. 2, the whole device may be pulled out of the well for replacement purposes. When a new bit is inserted, then the reverse operation is effected, that is, the bit is lowered down through the bore 33, until its lower member 8 abuts with the inwardly directed flange 22, said lower member 8 being provided with a pair of guiding bolts 21 which are engaged with a shoulder 20 provided at the lower end of bore 33 and in member 35, as more clearly shown in FIG. 2 of the drawings, such that said bolts will slide on the shoulders 20 which open upwardly at an angle of nearly 180° and close downwardly at an angle of nearly 0°, whereby whichever may be the position of the bolts 21 when the bit is lowered down, said position will be corrected such that, when the bit is placed with its lower member 8 abutting against the flange 22, the bit will arrive in the appropriate position to place the knives 10 against their respective backing member 3 at the bottom of body 35.

Once the lower cylindrical member 8 abuts the inwardly direct flange 22 of member 35, a further release of the cable 27 will lower down the upper member 9, with the rod 12 fixed through its connection 31 with bar 30 of member 8 which has been stopped by the flange 22, whereby member 9 will be approached to member 8 and the links 18 will be actuated inversely by means of the bar 14, to push the pivots 17 on the inner ends of the knives, thus rotating the same through an angle of approximately 90° to place them back in the position shown in FIG. 1 of the drawings.

In order to effect the above operations, it may be necessary to lift a short distance the body 1 (and the drilling string), so as to give sufficient room for the rotation of the knives, but this is not comparable to the full disassemblage and extraction of the drilling string for purposes of inserting a new bit built in accordance with the prior art.

Upon completion of rotation of the knives 10 to the position shown in FIG. 1, the drilling string is rotated in its normal direction whereby the hooks 28 will be disengaged from the hooks 23, and the pulling member may be pulled out of the bore 33 by means of the cable 27, leaving the bit in condition of resuming the drilling operation.

Although certain specific embodiments of the invention have been shown and described above, it is to be understood that many modifications thereof are possible. The present invention, therefore, is not to be restricted except insofar as is necessitated by the prior art and by the spirit of the appended claims.

What is claimed is:

1. A retractable drilling bit comprising a hollow body which forms the lowermost end of the drilling string; a circular opening at the free end of said body and of a reduced diameter forming an inwardly extending annular flange, a lower tubular knife-supporting member insertable into the bore of said string down to abutment with said annular flange, an upper tubular member colinearly arranged above said knife-supporting member; a vertical rod connected to said lower tubular member and slidable within said upper member between a knife-retracted and a knife-extended position; a pair of knives pivotally supported at the lower end of said rod at a point intermediate the length of each knife; a pulling member engageable to said upper tubular member to pull the same upwardly and space it from said lower tubular member; and a pair of crossed links the upper ends of which are pivotally engaged to said upper tubular member and the lower ends of which are respectively pivotally engaged to a point of each knife nearer to the knife end than said pivotal point between the knives and the vertical rod, whereby upon pulling said upper tubular member said knives are pulled by said links and rotated for an angle of approximately 90° to place them vertical thus retracting same, whereas when said upper tubular member is brought to contact with said lower tubular member against said annular flange, said knives are pushed by said links and rotated in the opposite direction to extend the same, further comprising, at the lower face of said hollow body, a pair of conical rollers arranged perpendicularly to said knives, whereby to provide two additional supports for the lowermost end of the bit in order to secure the vertical position thereof for obtaining a vertical bore.

2. A retractable drilling bit according to claim 1 wherein, at the lower face of said hollow body, a pair of blunt projections are arranged radially extending at an angle of 90° with respect to said knives, in order to provide two additional supports for securing the vertical position of the bit to thereby obtain a vertical bore.

3. A retractable drilling bit according to claim 1 wherein the inner cylindrical bore of said hollow body is provided with two pairs of inclined shoulders forming guides which open upwardly at an angle of nearly 180° each and coverge downwardly to an angle of nearly 0°, a pair of diametrically opposed bolts attached to the outer surface of said lower knife-supporting tubular member to be guided by said guiding shoulders in order to place the bit in the appropriate position to arrange the knives always in the same position with respect to said hollow body, and a pair of backing members integrally provided on the lower face of said body in order to back up said knives, from behind, for the purpose of increasing their resistance.

4. A retractable drilling bit according to claim 1 wherein said pulling member comprises a cylindrical member having a plurality of downwardly directed hooks, whereas the upper edge of said upper tubular member is provided with a series of complementary hooks which may be hooked through rotation of the drilling string with the hooks of said pulling member for purposes of engaging the said upper tubular member with said pulling member for actuating the same.

5. A retractable drilling bit according to claim 4 wherein said pulling member is provided with a plurality of radially directed guiding bolts which bear on the inner surface of the string.

6. A retractable drilling bit according to claim 1 wherein a plurality of bores are provided from the central bore of said hollow body to the lower face thereof, for the purpose of injecting drilling muds or fluids into the bore.

7. A retractable drilling bit according to claim 1 wherein said upper knife-supporting member is provided with a plurality of radially directed guiding bolts which bear on the inner surface of the string.

* * * * *